US007140839B2

(12) United States Patent
McAuliffe et al.

(10) Patent No.: US 7,140,839 B2
(45) Date of Patent: Nov. 28, 2006

(54) VARIABLE AREA DIFFUSER VANE GEOMETRY

(75) Inventors: Christopher McAuliffe, Windsor, CT (US); Mark L. Harris, Broad Brook, CT (US); Brent Merritt, Southwick, MA (US); Ronald Struziak, Longmeadow, MA (US)

(73) Assignee: Hamilton Sundstrand, Windsor Locks, CT (US)

( * ) Notice: Subject to any disclaimer, the term of this patent is extended or adjusted under 35 U.S.C. 154(b) by 177 days.

(21) Appl. No.: 11/023,935

(22) Filed: Dec. 28, 2004

(65) Prior Publication Data

US 2006/0062665 A1 Mar. 23, 2006

Related U.S. Application Data

(60) Provisional application No. 60/611,942, filed on Sep. 22, 2004.

(51) Int. Cl.
*F04D 29/46* (2006.01)

(52) U.S. Cl. ..... 415/163; 415/171.1

(58) Field of Classification Search ..... 415/159, 415/163, 164, 171.1, 173.7, 208.2
See application file for complete search history.

(56) References Cited

U.S. PATENT DOCUMENTS 3,101,926 A * 8/1963 Weber ..... 415/110
3,601,497 A * 8/1971 Mayo ..... 415/163

* cited by examiner

*Primary Examiner*—Edward K. Look
*Assistant Examiner*—Dwayne J White
(74) *Attorney, Agent, or Firm*—Carlson, Gaskey & Olds

(57) ABSTRACT

A diffuser is provided having a spaced apart shroud and backing plate. A diffuser vane is provided between the backing plate and shroud. The vane includes first and second sealing surfaces opposite from one another and adjacent to the backing plate and shroud. Leading and trailing surfaces are arranged opposite from one another and adjoin the first and second sealing surfaces. The first sealing surface includes a first protrusion extending therefrom approximate to the leading surface with a gap extending from the trailing surface to the first protrusion. The second surface includes a second protrusion extending therefrom proximate to the trailing surface with a second gap extending from the leading surface to the second protrusion. The surfaces provide four corners such that the protrusions are arranged on opposite corners from one another to create a pressure differential between the first and second sealing surfaces.

18 Claims, 3 Drawing Sheets

VARIABLE AREA DIFFUSER VANE GEOMETRY

The present application claims priority to U.S. Provisional Patent Application Ser. No. 60/611,942, filed Sep. 22, 2004.

BACKGROUND OF THE INVENTION

This invention relates to a variable area diffuser, and more particularly, the invention relates to geometry of the diffuser vanes.

Variable area diffusers use multiple vanes that are rotated between different angular positions to vary the throat size of the diffuser. Variable area diffusers can be used in conjunction with, for example, superchargers to vary the flow through an air conditioning system of an aircraft. The vanes are supported between a backing plate and a shroud of the diffuser. A small clearance a few of thousandths of an inch is provided between the vane and backing plate and shroud to minimize the loads and wear between these components. As a result, the life of the diffuser vanes is improved.

Under some supercharger operating conditions it is possible to produce an unstable airflow condition. The unstable airflow condition creates a hydrodynamic bearing-like layer between the vanes and the backing plate and shroud. As a result, the vanes are permitted to float freely between the backing plate and shroud. As the length of the vanes increases, the vanes may have a resonant frequency within the operating range of the supercharger. As a result, in some applications the vanes may reach resonant frequency and fail as the vanes oscillate violently at a high frequency between the backing plate and shroud.

What is needed is a diffuser vane geometry that is not excited at its resonant frequency during normal supercharger operating conditions.

SUMMARY OF THE INVENTION

The present invention provides a diffuser having a spaced apart shroud and backing plate. A diffuser vane is provided between the backing plate and shroud. The vane includes first and second sealing surfaces opposite from one another and adjacent to the backing plate and shroud. Leading and trailing surfaces are arranged opposite from one another and adjoin the first and second sealing surfaces. The leading surface is on a high pressure side, and the trailing surface is on a low pressure side. The first sealing surface includes a first protrusion extending therefrom proximate to the leading surface with a gap extending from the trailing surface to the first protrusion. The second surface includes a second protrusion extending therefrom proximate to the trailing surface with a second gap extending from the leading surface to the second protrusion. The gaps enable the high and low pressure sides to communicate with the first and second sealing surfaces.

The surfaces provide four corners such that the protrusions are arranged on opposite corners from one another to create a pressure differential between the first and second sealing surfaces. The pressure differential loads the vane against either the backing plate or the shroud so that the vane does not resonate during normal supercharger operating conditions.

These and other features of the present invention can be best understood from the following specification and drawings, the following of which is a brief description.

DETAILED DESCRIPTION OF THE PREFERRED EMBODIMENT

Figure 1:
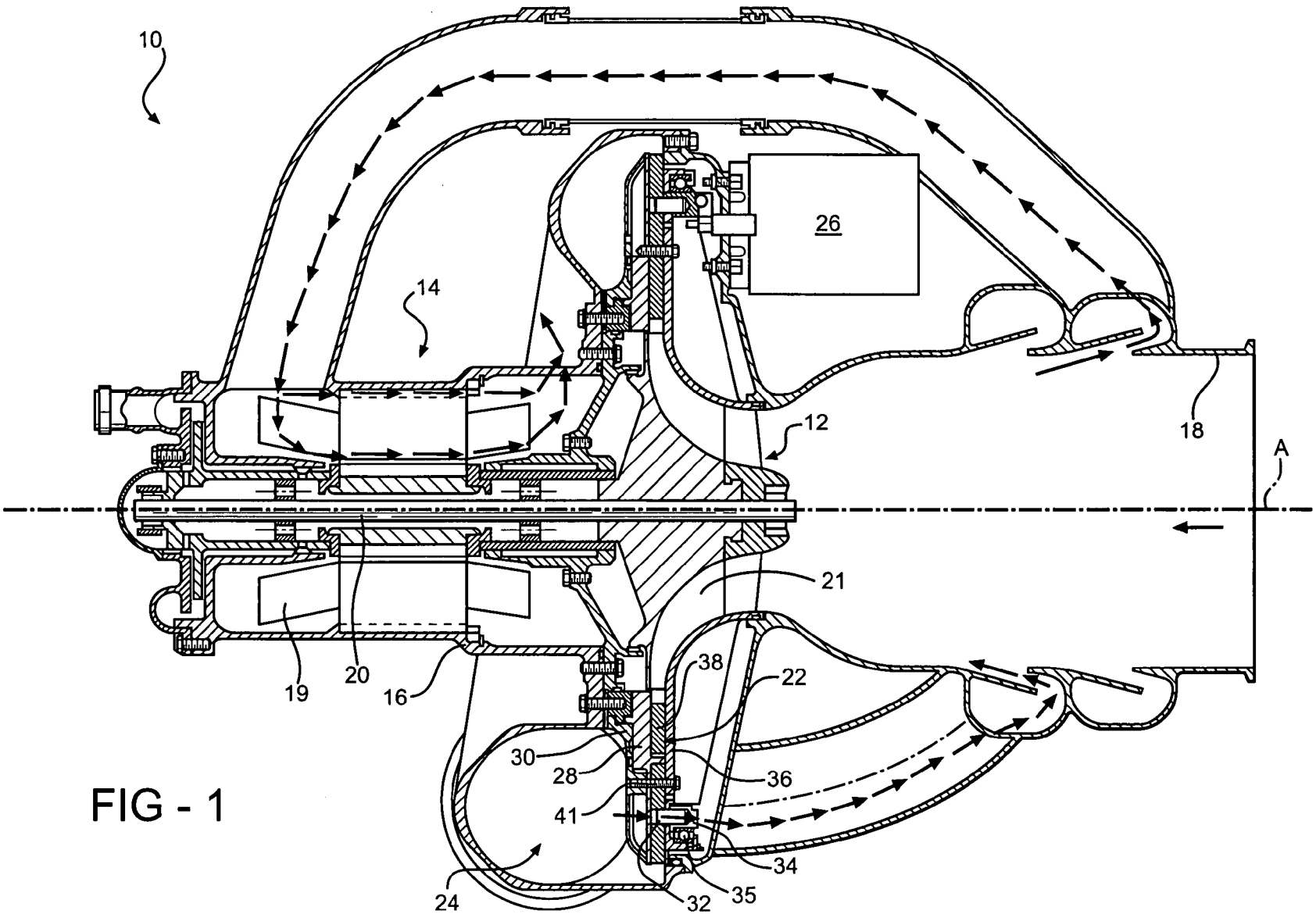
FIG. 1 is a cross-sectional view of a compressed air unit.

A compressed air unit 10 is shown in FIG. 1. The unit 10 includes a compressor rotor 12 driven by an electric motor 14. It should be understood, however, that the inventive diffuser may be used in other, non-electric motor applications. The compressor rotor 12 and electric motor 14 are contained within the housing 16, which may be constructed from multiple housing portions secured to one another. The housing 16 provides an inlet 18 for providing air to the compressor 12. A motor rotor 20 is disposed within a motor stator 19 and is rotatable about an axis A. The rotor 20 supports compressor rotor with blades 21. A diffuser assembly 22 is arranged radially outward of the blades 21. Air drawn through the inlet 18 is pumped radially outwardly to an outlet 24 by the blades 21 through the diffuser 22.

An actuator 26 cooperates with the diffuser 22 to vary the inlet throat to vary the flow rate through the unit 10. In one example, the unit 10 provides pressurized air to an air cycle air conditioning pack of an aircraft.

Figure 2:
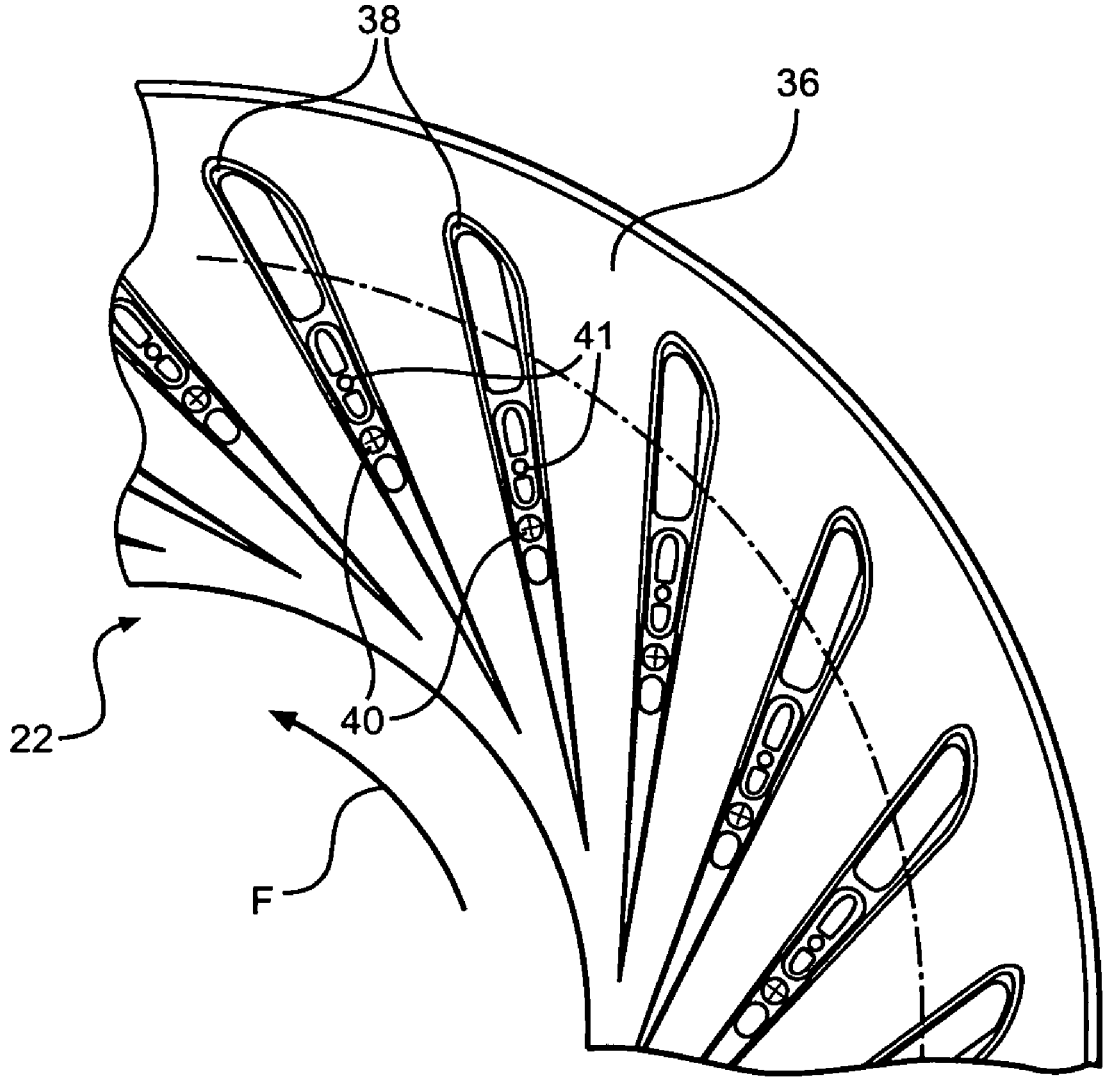
FIG. 2 is a partially broken top elevational view of a diffuser used in the system shown in FIG. 1.

Referring to FIGS. 1 and 2, the diffuser 22 includes a backing plate 28 supported by a mounting plate 30. A shroud 36 is supported by the housing 16. Multiple vanes 38 are retained between the backing plate 28 and shroud 36 and, typically, a few thousandths of clearance is provided between the vane 38 and the backing plate 28 and shroud 36. In the example system shown, there are 23 vanes that are modulated between full open and 40% of full open. Air flows into the diffuser 22 as indicated by the arrow F.

Figure 4:
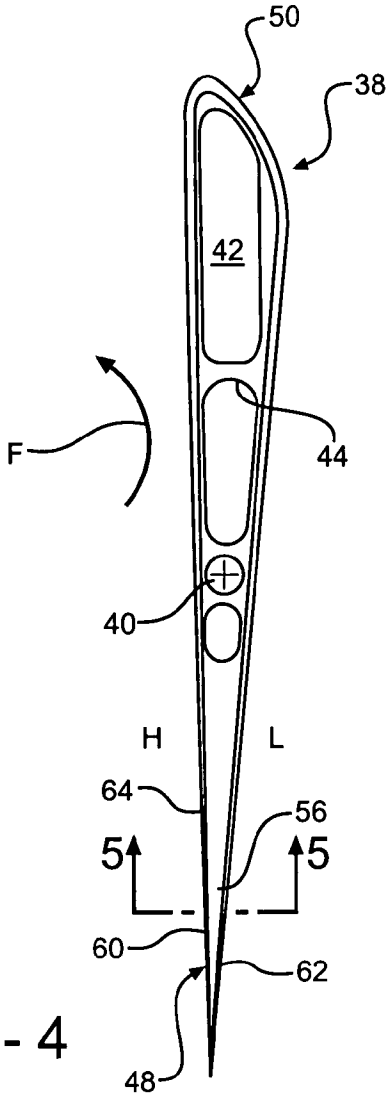
FIG. 4 is a top elevational view of a vane shown in FIG. 3.
Figure 3:
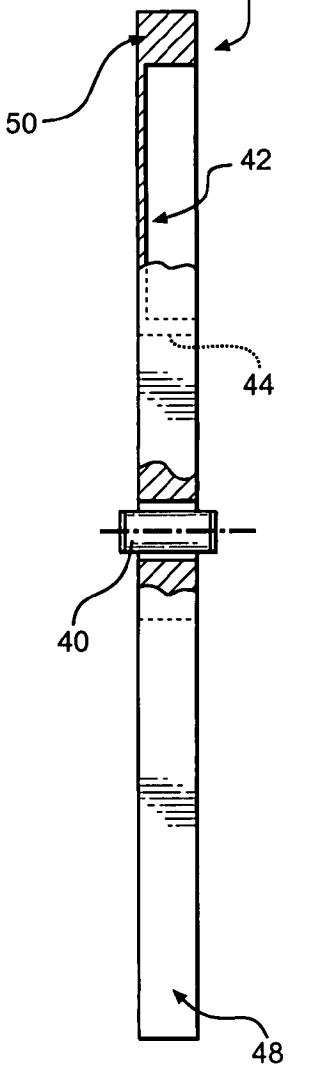
FIG. 3 is a side elevational view, partially broken, of a diffuser vane.

Referring to FIGS. 2–4, each vane 38 includes a hole for receiving a pivot pin 40. The pivot pin 40 extends through an opening in the shroud 36 to the mounting plate 30 to secure the vane 38 between the shroud 36 and backing plate 28. The vanes 38 include an inlet end 48 and an outlet end 50. The inlet end 48 provides an adjustable throat diameter pivoting the vanes 38 about pin 40. The vanes 38 include a slot 42 that receives a drive pin 32. The drive pins 32 are mounted on a drive ring 34 that is rotated by the actuator 26 to rotate the vanes 38 about the pivot pins 40. The drive ring 34 includes bearings 35 supporting the drive ring 34 in the housing 16.

An aperture 44 arranged between the inlet and outlet ends 48 and 50. Bolts 41, shown in FIGS. 1 and 2, extend through the aperture 44 to secure the vane 38 between the shroud 36 and backing plate 28.

Figure 5:
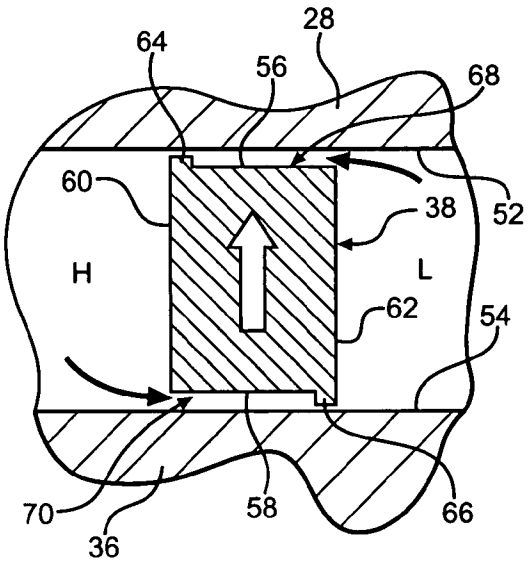
FIG. 5 is an enlarged cross-sectional view of the vane taken along line 5—5 in FIG. 4.

Referring to FIGS. 4 and 5, the backing plate 28 and shroud 36 respectively include backing plate and shroud sealing surfaces 52 and 54. The vane 38 includes spaced apart, opposing first and second sealing surfaces 56 and 58 that are arranged adjacent to the sealing surfaces 52 and 54. The vane 38 also includes spaced apart, opposing leading and trailing surfaces 60 and 62 that extend between the first and second sealing surfaces 56 and 58. The leading surface 60 is on a high pressure side H, and the trailing surface 62 is on a low pressure side L. Together the surfaces 56, 58, 60 and 62 provide four corners.

The vane 38 includes first and second protrusions 64 and 66 on opposite corners to create a pressure differential that forces the vane 38 against either the backing plate 28 or shroud 36. In the prior art, there was no pressure differential such that the vane 38 would float between the backing plate 28 and shroud 36 on a hydrodynamic air film at a resonant frequency of the vane 38.

The first and second protrusion 64 and 66 extend from the first and second surfaces 56 and 58, respectively. In one example, the protrusions 64 and 66 extend approximately ten thousandths of an inch or greater from the sealing surfaces 56 and 58. The protrusion has a width of approximately forty thousandths of an inch, for example. In one embodiment, a clearance of two thousandths of an inch is provided between the protrusions 64 and 66 and the backing plate 28 and shroud 36.

A first gap 68 is provided between the first sealing surface 56 and the backing plate 28. In the example shown, the first gap 68 extends from the first protrusion 64, which is arranged proximate to the leading surface 60, to the trailing surface 62 such that the low pressure at the trailing surface 62 is permitted to act on the first surface 56. Similarly, the second gap 70 is provided between the second surface 58 and the shroud 36. In the example shown, the second gap 70 extends from the second protrusion 66, which is proximate to the trailing surface 62, to the leading surface 60. The high pressure is permitted to act upon the second surface 58. As a result of the pressure gradient between the high and low pressure sides, the higher pressure acting on the second surface 58 will force the vane 38 into engagement with the backing plate 28, in the example shown, thereby preventing the vane 38 from floating between the backing plate 28 and shroud 36 at a resonant frequency. The pressure differential is approximately 20 psi in one example.

Referring to FIG. 4, the protrusions 64 and 66 are provided at the periphery of each side of the vane 38. However, at the inlet end 48, there is a break in the protrusions (only one side of the vane 38 having the protrusion 64 is shown) to create the pressure differential on the first and second surfaces 56 and 58 at the inlet end 48.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A diffuser vane comprising:

first and second sealing surfaces opposite from one another, leading and trailing surfaces opposite from one another and adjoining the first and second sealing surfaces, the first sealing surface including a first protrusion extending there from proximate to the leading surface with a first gap extending from the trailing surface to the first protrusion, and the second surface including a second protrusion extending there from proximate to the trailing surface with a second gap extending from the leading surface to the second protrusion.

2. The diffuser vane according to claim 1, wherein the first and second sealing surfaces and leading and trailing surfaces provide four corners, the protrusions arranged on opposite corners from one another.

3. The diffuser vane according to claim 1, wherein the protrusions extend approximately ten thousandth of an inch or greater from the sealing surfaces.

4. The diffuser vane according to claim 3, wherein the protrusions have a width of approximately forty thousandths of an inch.

5. The diffuser vane according to claim 1, wherein one of the sealing surfaces provides a high pressure side and the other of the sealing surfaces provides a low pressure side.

6. The diffuser vane according to claim 5, wherein a differential pressure between the high and low pressure sides is approximately ten to twenty pounds per square inch.

7. The diffuser vane according to claim 1, wherein the vane includes opposing inlet and outlet ends, the inlet end for providing a throat diameter, the gaps provided at the inlet end.

8. The diffuser vane according to claim 7, wherein the outlet end includes a third protrusion extending from the first sealing surface proximate to the trailing surface, and a fourth protrusion extending from the second sealing surface proximate to the leading surface, the sealing surfaces recessed relative to the protrusions.

9. The diffuser vane according to claim 8, wherein the protrusions proximate to the leading surfaces extend to the leading surfaces, and the protrusions proximate to the trailing surfaces extend to the trailing surfaces.

10. A diffuser comprising:

a spaced apart shroud and backing plate; and a vane including first and second sealing surfaces spaced apart from one another and arranged adjacent to the shroud and backing plates, leading and trailing surfaces spaced from one another and adjoining the first and second sealing surfaces, the first surface including a first protrusion extending from the first sealing surface proximate to the leading surface, and the second surface including a second protrusion extending from the second sealing surface proximate to the trailing surface, and gaps adjoining the protrusions and arranged between the first and second sealing surfaces and the shroud and backing plates, respectively, providing a low pressure area at the first sealing surface and a high pressure area at the second sealing surface that is higher than the low pressure area.

11. The diffuser according to claim 10, wherein the first and second sealing surfaces and leading and trailing surfaces provide four corners, the protrusions arranged on opposite corners from one another.

12. The diffuser according to claim 11, wherein the vane includes opposing inlet and outlet ends, the inlet end for providing a throat diameter, the gaps provided at the inlet end, the outlet end includes a third protrusion extending from the first sealing surface proximate to the trailing surface, and a fourth protrusion extending from the second sealing surface proximate to the leading surface, the sealing surfaces recessed relative to the protrusions.

13. The diffuser according to claim 10, comprising multiple vanes rotatable between multiple positions about pivot pins.

14. The diffuser according to claim 10, wherein approximately two thousandths of an inch clearance is provided between the protrusions and the backing plate and shroud.

15. The diffuser according to claim 14, wherein the protrusions extend approximately ten thousandth of an inch or greater from the sealing surfaces away from the backing plate and shroud.

16. The diffuser according to claim 10, wherein the vane includes first and second spaced apart peripheries, the first protrusion arranged about the first periphery and broken by a first gap, and the second protrusion arranged about the second periphery and broken by a second gap.

17. The diffuser according to claim 16, wherein the vane includes opposing inlet and outlet ends, the inlet end for providing a throat diameter, the gaps provided at the inlet end.

18. The diffuser according to claim 10, wherein the vane moves in a direction away from the high pressure area toward the low pressure area.

* * * * *